United States Patent [19]

Cesati

[11] 4,429,762

[45] Feb. 7, 1984

[54] HORN LOUDSPEAKERS OF THE SECTORIAL DIFFUSION TYPE, AND METHOD FOR MAKING SAID LOUDSPEAKERS

[76] Inventor: Mario Cesati, Via de Vitalis, 16, Brescia, Italy

[21] Appl. No.: 259,559

[22] Filed: May 1, 1981

[51] Int. Cl.[3] ..... G10K 11/10

[52] U.S. Cl. ..... 181/159; 181/151; 181/152; 181/192

[58] Field of Search ..... 181/151, 152, 164, 165, 181/166, 177, 180, 159, 192; 179/101, 180, 181 R, 181 F

[56] References Cited

U.S. PATENT DOCUMENTS 3,866,710 2/1975 Cesati ..... 181/159

3,944,757 3/1976 Tsukamoto ..... 181/152 X

*Primary Examiner*—Benjamin R. Fuller

*Attorney, Agent, or Firm*—Bucknam and Archer

[57] ABSTRACT

There is disclosed a method for making horn loudspeakers, of the sectorial diffusion type, characterized by the transformation, in order to operate under predetermined sectorial diffusion conditions, of a horn loudspeaker, predisposed for circular diffusion, comprising a horn provided with opposite walls the distances whereof increase according to a given law, from the axis of the horn on which the electroacoustic transducer is located, the transformation being carried out by neutralizing the space included between the walls and about the compression chamber associated with the transducer, and in the directions in which the diffusion is not desired, by using a substantially fibrous material and effective to absorb or deaden the acoustic energy or power.

4 Claims, 3 Drawing Figures

Fig. 1
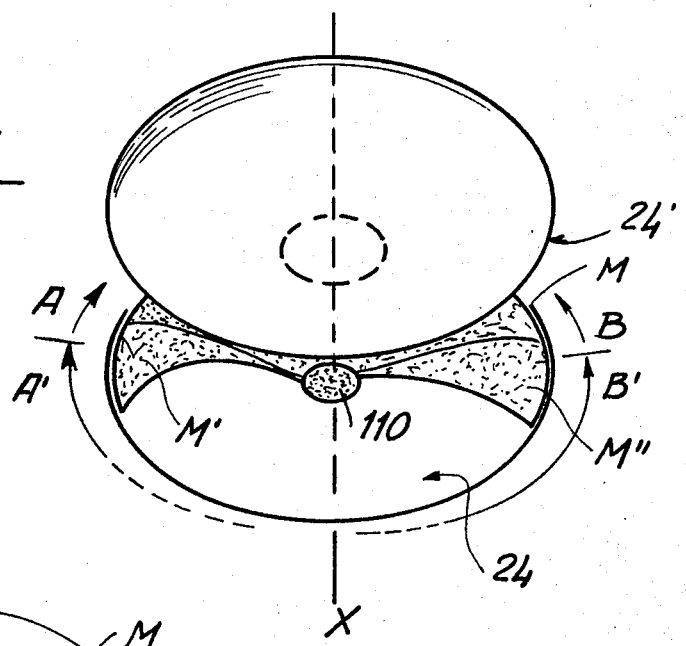
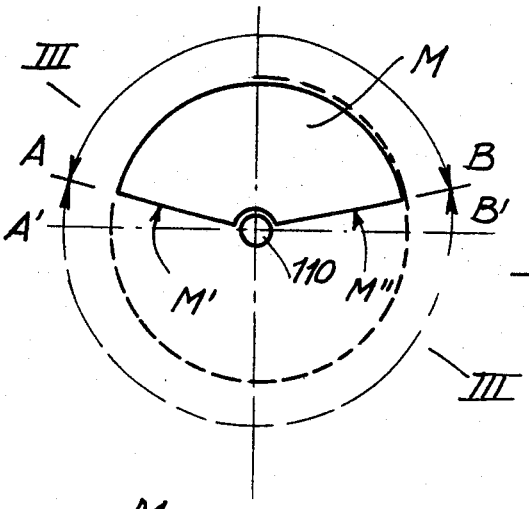
Fig. 2
Fig. 3
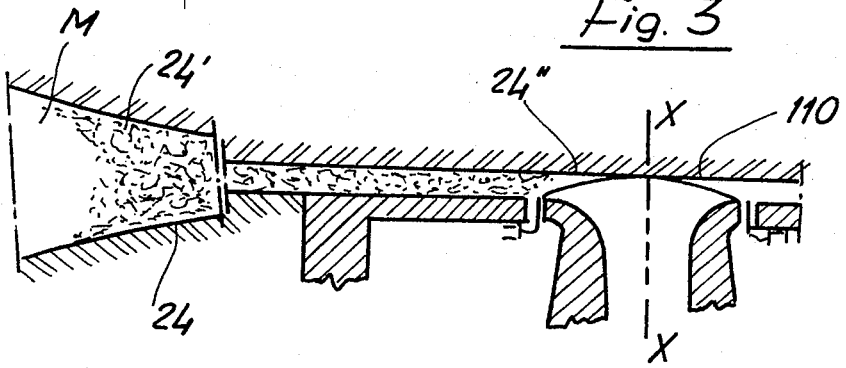

HORN LOUDSPEAKERS OF THE SECTORIAL DIFFUSION TYPE, AND METHOD FOR MAKING SAID LOUDSPEAKERS

The present invention relates to improvements in and/or related to the horn loudspeakers, of the sectorial diffusion type, and to a method for industrially making said sectorial diffusion loudspeakers, as described hereinbelow.

Well known are the loudspeakers in general, as well as the so-called horn loudspeakers, which latter comprise a movable diaphragm effective to move in such a way as to reproduce the time variation of a signal driving the diaphragm (according to a known procedure and by known means), which diaphragm is located and operates at the mouth (the so-called throat) of a horn or a rigid duct of gradually increasing cross-section and ending with an opening or mouth leading to the atmosphere of the environment in which the loudspeaker is installed and operates for diffusing or irradiating sounds.

Thus the horn is to be considered an acoustic transformer effective to transform the comparatively small area diaphragm into a large area diaphragm, thereby fitting to a comparatively heavy diaphragm the light medium or air. This definition is actually proper for the loudspeakers provided with the so-called "large-throat" horns, provided with a throat having approximately the same size as the diaphragm: on the other hand this condition may be only met, without interference losses, for the frequencies for which the wavelength is at least four times the size of the diaphragm.

This limitation does not occur for the so-called "narrow throat" horn loudspeakers, that is the so-called compression loudspeakers. In this case the horn is so designed that from the diaphragm the horn (or rigid duct or ducts of gradually increasing cross-section-for example exponentially increasing) is reached through the so-called compression chamber, effective to increase the average density of the medium (air) and being formed by the surface of the diaphragm itself and by an opposite wall located very close to said diaphragm and interrupted by openings for the passage of the horn. This passage occurs by means of channels the number, positions and size of which are such as to nullify the higher order resonances in said compression chamber and due to the perturbations arising from the reflections generated by the surface of said chamber edge.

Well known are also loudspeakers predisposed for an essentially "circular" diffusion and for an essentially "sectorial diffusion". More specifically the former, also in the case of the "narrow throat" horn loudspeakers (which may also be provided with several horns associated with corresponding diaphragms) comprise a horn having a circular mouth opening on the contour of a revolution body, about an axis passing through the compression chamber. Also known are circular diffusion loudspeakers comprising an electroacoustic transducer loop as located about the axis of the loudspeaker structure. A main requirement of the circular diffusion loudspeakers is that the acoustic energy or power be transmitted and diffused to/through the medium or environmental air in an even way and without deleterious interferences in any directions.

The Applicant, in its Italian Pat. No. 930,955 granted on Oct. 2, 1972 (Patent Application No. 25,696 filed on June 9, 1971) has already disclosed and illustrated an improved loudspeaker, in particular predisposed for an essentially circular diffusion, effective to provide a response curve being practically flat in the overall frequency range. Exemplary embodiments of these improved loudspeakers, for essentially circular diffusion, have been fragmentarily illustrated in FIGS. 10a and 10b and more specifically in FIGS. 11a and 11b and they are described, with reference to the mentioned figures, in said Italian Pat. No. 930,955, herein incorporated by reference.

According to the aforesaid Italian patent of the same Applicant, the circular diffusion loudspeaker (it should be noted that also a sectorial diffusion has been already provided for in said Italian patent), comprised a diaphragm effective to operate in the compression chamber, against an opposite wall defining the starting portion of a horn circularly extending about an axis passing through the center of said compression chamber. The progressive increase of the horn cross-sections was in a plane perpendicularly to the axis or in a cone having a very large maximum opening and a corresponding axis.

These loudspeakers have been greatly satisfactory in operation, as confirmed both by the tests and the wide industrial acceptance, with respect both to the response curve which is essentially flat for the overall acoustic frequancy range and to the evenness of the circular diffusion in any directions about said axis.

Finally, there is also known that in the market are ever increasingly required by those skilled in the art the so-called "sectorial diffusion" loudspeakers, that is those loudspeakers effective to diffuse or irradiate into a predetermined space sector, which sector is generally, though not critically included from 90° to 120° and even, in some cases, 180° and more.

Also known is the fact that a substantially even diffusion through the overall acoustic frequency range, in the absence of interference phenomena, and through angles greater than 120° is hard to be obtained, from the constructional, designing, testing point of view and with respect to the making of the loudspeakers.

A mainly sectorial diffusion or irradiation is advantageous for example for assuring a high fidelity irradiation and reception of music which is generally irradiated from a point offset with respect to the listeners. The acoustic characteristics can be for example seriously damaged by the perturbing echoes and reflections from the walls which are nearer to the loudspeakers or loudspeaker.

Several techniques are known for producing the sectorial diffusion loudspeakers. As thereinabove stated loudspeakers have been designed comprising a plurality of transducers (or diaphragms) and horns, as differently oriented. Typically one may affect the geometry and average orientation of the walls of the horn or horns, but, in general, the asymmetrical distribution of these walls, originating with sharp deviations from the compression chamber, causes interference phenomena or other deleterious factors which impair the evenness of listening, through the overall acoustic frequency range.

Owing to the fact that, as it will be thereinafter illustrated, the instant improvement is critically based on the applications of the teachings and technical solutions according to the thereinabove mentioned Italian Pat. No. 930,955, the circular diffusion loudspeakers, said diffusion being in a plane or large opening cone, of said Italian patent will be thereinafter indicated by the term "improved circular diffusion loudspeaker".

Essentially, according to the present invention, there is applied the unforeseeable outcome (being experimentally confirmed) that an improved circular diffusion loudspeaker may be qualitatively transformed into a sectorial diffusion loudspeaker by at least partially neutralizing the sector of the horn, oriented in the directions in which the diffusion is not desired or has to be attenuated, by using an acoustically dissipating and absorbing or deadening material, by which the irradiated acoustic power or energy, as irradiated by the compression chamber, is absorbed.

Preferably said deadening and absorbing material occupies all of the space included, in said directions, between the walls of the horn and has corresponding absorption characteristics for the acoustic power even at the limiting portions of the occupied sector.

Said material may also be different, while providing the same acoustic deadening and neutralizing characteristics.

Preferably said material can be of the cellular or fibrous type (formed from individually non rigid fibers).

Preferably a sponge or fibrous mass is employed, such as Kapok, cotton, wool, silk, and so on and related waste of either natural or synthetic fibres, of polyurethane foam or the like.

Furthermore the occupied space can be partially or completely neutralized, from the acoustic point of view, by a different-density material (for example made or less compact fibers) at points located at different distances from the compression chamber, in order to assure a progressively increasing absorption, to the full one, at the different distances from the electroacoustic transducer.

Thus the method according to the present invention broadly consists of providing a circular diffusion loudspeaker, of the thereinabove indicated type, and as thereinafter defined again, which loudspeaker comprises a horn evenly located about an axis (either plane or conic) passing through the compression chamber at least partially neutralizing, from the acoustic point of view, the channel formed by said horn, in the directions in which the diffusion has to be attenuated or suppressed, by sectorialy adding an acoustically deadening or absorbing material and effective to neutralize said diffusion, in such a way as to obtain the desired attenuation or suppression of said diffusion, in said directions.

The provision of said deadening material, under the thereinafter indicated conditions, and according to the desired nature, consistency, absorbing properties is effective to give the desired attenuation or sectorial suppression of the acoustic diffusion through the environment. Thereinafter there will be indicated some possibilities for the selective production of these effects.

The method obviously affords important complementary advantages involving the making of the improved sectorial horn according to the present invention.

Obviously the sectorily diffusion properties of the loudspeaker depend on the angular width or amplitude and the orientation of the sectors occupied by the insulating material. Accordingly, by maintaining the standardization of the production of the loudspeaker, originally provided for the circular diffusion, the fitting whereof to the desired sectorial diffusion simply requires the provision and applying of a sound deadening and absorbing mass having the desired angular extension and orienting.

For example the mass may be modularly predisposed in small-angular width sectors, effective to be individually shaped, for example by pressing in a suitable mold, and the loudspeakers can be predisposed, according to the user's needs, by inserting into the perimetrical portion or sector to be at least partially neutralized of the horn, the desired number of these modular articles of manufacture. If it is desired, it is possible to provide loudspeakers having a plurality of sectors, as angularly spaced and differently oriented, in which the starting diffusion performance is attenuated or suppressed.

The aforesaid and other characteristics of the invention will become more apparent from the following detailed description of a possible embodiment whereof, with reference to the schematic drawing, where:

FIG. 1 is a perspective view of the improved sectorial loudspeaker according to the present invention, as substantially produced by using a circular diffusion loudspeaker, as improved according to the thereinabove mentioned Italian Pat. No. 930,955;

FIG. 2 illustrates the sound deadening mass of the loudspeaker of FIG. 1, by a cross-section taken according to a plane perpendicular to the axis whereof, and FIG. 3 illustrates a cross-section of the improved sectorial loudspeaker, taken through the slanted plane indicated at III—III in FIG. 2, the structure and transducer of the loudspeaker corresponding to those fragmentarily illustrated in FIG. 11A of the thereinabove mentioned Italian patent.

With reference to the drawing figures and briefly recalling to mind the disclosure of the cited Italian patent, and as it is exemplary illustrated in FIG. 3, the loudspeaker as originally predisposed for an even circular diffusion or irradiation in any directions, comprises a known magnetodynamic unit, including a diaphragm 110 (for convenience there are used those same number references as used in the aforesaid FIG. 11A of the cited Italian patent) operating in opposition to an opposite wall 24'', or an opposite diaphragm, thereby forming with the latter a duct as defined between opposite progressively diverging walls 24 and 24', the distance of which increase according to a law well known in the art.

As disclosed in the cited Italian patent, the geometric progression at the several cross-sections or the central portion of this duct (forming the compression chamber) is obtained by the bending of the sole diaphragm 110.

Thus, within the limits of this structure, that is without considering the following disclosure, the loudspeaker of FIG. 3 is effective to circularly irradiate in any directions about its axis x-x, with the qualitative characteristic of supplying a substantially flat response curve through the overall acoustic frequency range, being a high quality loudspeaker.

According to the present invention, it has been found that it is possible to produce, by a technologically simple procedure and starting from a circular diffusion loudspeaker, sectorial diffusion loudspeakers, for the desired angular width or widths, or sectorily reducing the diffusion or irradiation of said circular diffusion loudspeaker.

As it is schematically illustrated in the figures, this is obtained by arranging in the radially diverging channel between the opposite walls 24 and 24' of the circular horn a mass M of a selectively sound deadening or adsorbing material, by which at least partially the acoustic power or energy generated by the diaphragm 110 or the electroacoustic transducer is absorbed.

In the practice, as it is shown in FIGS. 1 and 2, and assuming that it is desired to produce a loudspeaker effective to irradiate exclusively (or at least with a good approximation) into the sector A'-B', the mass M will be located in such a way as to completely or partially neutralize the space included between the diverging walls 24 and 24'' about the diaphragm 110, also occupying the immediately overlying space, that is the compression chamber originating the sound or acoustic pulses. Thus the sound pulses irradiating from said compression chamber in any directions included in the sector A-B will be absorbed by the mass M, while those irradiating in any directions included in the sector A'-B' continue undisturbed through the corresponding sector of the horn and they are sectorily diffused.

It has been experimentally found and verified that the selectively limited diffusion of the sector A'-B' preserves its quality characteristics, practically through the overall extension of the sector occupied by the mass M.

It has been further experimentally found and verified that the angular limits of the thus obtained sectorial diffusion are advantageously cleanly or sharply defined, that is the intensity and quality of the diffusion is nullified in an advantageous sharp way at the limiting portions of said sectors, preferably provided that the faces M' and M'' defining the sector of the mass M, and which are accordingly turned towards the interspace between the opposite walls 20 and 24' of the horn, are in turn well sound deadening or absorbing and practically impervious to the sound or acoustic waves.

From the above description and the examination of the accompanying drawing it should be evident that it is possible to produce sectorial diffusion loudspeakers for any desired extension or amplitude.

As thereinabove said the improved loudspeaker can be made by using modular sectors of the mass M, the number and mutual positions of which can be selected at will, to meet the user requirements, depending on the extension and location of the loudspeaker in the room wherein it has to be installed. Furthermore, it is easy and economical to fit an improved loudspeaker, already predisposed for a predetermined condition of sectorial diffusion to other different conditions, by replacing the sound deadening mass M and/or the modular sectors jointly or individually forming said mass.

Accordingly it should be evident that the improvement according to the present invention can be carried out by adopting several variations and modifications of constructional nature, without departing from the scope of the present invention, as defined in one or more of the following claims.

I claim:

1. A loudspeaker of the sectorial diffusion type, which comprises two first opposite walls forming a horn, an electroacoustic transducer provided with a curved diaphragm tangentially contacting a third wall, said diaphragm and said third wall forming a structure, said two first walls being arranged in a direction essentially perpendicular to the vertical axis of said structure, and converging towards said structure, said diaphragm, said third wall and said horn forming a compression chamber, a mass of fibrous material in a sector of said compression chamber in an amount sufficient to absorb the acoustic power irradiated from the compression chamber in a predetermined direction in which diffusion or sound has to be deadened.

2. The loudspeaker according to claim 1 wherein said fibrous material is made of individually non-rigid fibers.

3. The loudspeaker according to claim 2 wherein the density of said fibrous material increases from the points thereof near to said electroacoustic transducer to the points thereof near the contour of said horn, whereby said horn is made sectorily attenuating or sound deadening.

4. An improved loudspeaker according to claim 1, 2 or 3 wherein the mass of said sound deadening material is formed by a plurality of modular portions located in the directions in which the diffusion is not desired or has to be attenuated.

* * * * *